US005685447A

United States Patent [19]

Springett et al.

[11] Patent Number: 5,685,447

[45] Date of Patent: Nov. 11, 1997

[54] AIR EXPELLING APPARATUS FOR A NURSING BOTTLE

[76] Inventors: Shaun Springett, 20432 88A Avenue, Langley, Canada, V1M 1A1; Vincent L. Mitchell, 34552 Ascott Avenue, Abbottsford, Canada, V2S 4V7

[21] Appl. No.: 622,426

[22] Filed: Mar. 25, 1996

[51] Int. Cl.[6] ..... A61J 9/06

[52] U.S. Cl. ..... 215/386; 215/11.1; 215/11.3; 215/395; 248/102

[58] Field of Search ..... 215/11.1, 11.3, 215/11.6, 326, 395; 248/102, 105

[56] References Cited

U.S. PATENT DOCUMENTS

| | | | |
|---|---|---|---|
| 3,648,873 | 3/1972 | Grobbel | 215/11.3 |
| 4,700,856 | 10/1987 | Campbell et al. | 215/11.3 |
| 4,813,556 | 3/1989 | Lawrence | 215/11.3 |
| 4,821,896 | 4/1989 | Cheng | 215/11.3 |
| 4,880,125 | 11/1989 | LeBeau | 215/11.3 |
| 4,979,629 | 12/1990 | Askerneese | 215/11.6 X |
| 5,033,631 | 7/1991 | Nightingale | 215/11.1 |
| 5,109,996 | 5/1992 | Sullivan | 215/11.6 |
| 5,524,783 | 6/1996 | Popoff | 215/11.6 X |

FOREIGN PATENT DOCUMENTS

| | | | |
|---|---|---|---|
| 2062243 | 9/1993 | Canada | 215/11.1 |

*Primary Examiner*—Sue A. Weaver

[57] ABSTRACT

An air expelling apparatus includes a cylindrical member that has a shell body with a closed top end, an opened bottom end and a peripheral wall with an interior area. A disk-like stand, is integral with the bottom end of the shell body, with the interior area of the shell having its opening at a bottom portion of the stand. The stand has a top portion integral with the peripheral wall of the shell body, and has a lower peripheral wall. Lastly, the stand is capable of functioning like a handle when the cylindrical member is positioned within the shell body of any disposable baby bottle. The stand allows the cylindrical member to operate in a piston-like manner when positioned through the lower opening of any disposable baby bottle and be in contact with the liner of a disposable baby bottle to expel air.

1 Claim, 3 Drawing Sheets

AIR EXPELLING APPARATUS FOR A NURSING BOTTLE

BACKGROUND OF THE INVENTION

1. Field of the Invention

The present invention relates to a air expelling apparatus and more particularly pertains to bleeding the air from the liner of a cylindrical disposable baby bottle by placing the shell body of the baby bottle over of cylindrical member and pushing down on the cylindrical member.

2. Description of the Prior Art

The use of air expellers for a baby bottle is known in the prior art. More specifically, air expellers for a baby bottle heretofore devised and utilized for the purpose of expelling unwanted air from the liner are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,033,631 to Nightingale discloses a method and apparatus for expelling air from a flexible liner baby nursing bottle. U.S. Pat. Des. 315,409 to Baarber discloses a combined baby bottle and disposable liner. U.S. Pat. No. 4,821,896 to Cheng discloses a nursing bottle with a liner and vent. U.S. Pat. No. 4,813,556 to Lawrence discloses a collapsible baby bottle with integral gripping elements and liner. U.S. Pat. No. 4,700,856 to Campbell et al. discloses a baby bottle with a disposable liner. Lastly, U.S. Pat. No. 3,548,077 to Ryan discloses a composite bottle cap with liner.

While these devices fulfill their respective, particular objectives and requirements, the aforementioned patents do not describe air expelling apparatus that allows air trapped in a flexible liner of any disposable baby bottle to be bled from within the liner prior to allowing the infant nursing the bottle, and keeping air out of the liner when the baby is not nursing from the bottle.

In this respect, the air expelling apparatus according to the present invention substantially departs from the conventional concepts and designs of the prior art, and in doing so provides an apparatus primarily developed for the purpose of bleeding the air from the liner of a cylindrical disposable baby bottle by placing the shell body of the baby bottle over of cylindrical member and pushing down on the cylindrical member.

Therefore, it can be appreciated that there exists a continuing need for a new and improved air expelling apparatus which can be used for bleeding the air from the liner of a cylindrical disposable baby bottle by placing the shell body of the baby bottle over of cylindrical member and pushing down on the cylindrical member. In this regard, the present invention substantially fulfills this need.

SUMMARY OF THE INVENTION

In view of the foregoing disadvantages inherent in the known types of air expellers for a baby bottle now present in the prior art, the present invention provides an improved air expelling apparatus. As such, the general purpose of the present invention, which will be described subsequently in greater detail, is to provide a new and improved air expelling apparatus and method which has all the advantages of the prior art and none of the disadvantages.

To attain this, the present invention essentially comprises an elongated cylindrical member having a shell body with a closed top end, an open bottom end and a peripheral wall therebetween. The shell body has an interior area. The peripheral wall of the shell body has a length of about five and one-half inches and a diameter of about two inches. The shell body has a generally tapered peripheral edge continuous with the peripheral wall and integral with the top end. Also, a disk-like stand is integral with the bottom end of the shell body with the interior area of the shell having its opening at the bottom portion of the stand. The stand has a top portion integral with the peripheral wall of the shell body. The stand has a lower peripheral wall with a generally tapered peripheral edge continuous therewith. The tapered peripheral edge of the stand is integral with the lower peripheral wall and the top portion. The lower peripheral wall and the peripheral edge combined, have a height of about three-eighths inch. The stand has a diameter of about three inches. The stand allows the cylindrical member to sit vertically on a receiving surface. Lastly, the stand is capable of functioning like a handle when the cylindrical body is positioned within the shell body of any disposable baby bottle. The stand is capable of continuously moving the cylindrical member along a rectilinear path in a direction away from and toward the lower opening of any disposable baby bottle. The stand allows the cylindrical member to operate in a piston-like manner when positioned through the lower opening of the baby bottle and causes out of and into contact with the liner of any disposable baby bottle. The cylindrical member, when moved into and out of contact with the liner, is capable of varying the volume of the liner for expulsion of air from therein and preventing reentry of air.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved air expelling apparatus which has all of the advantages of the prior art air expellers for a baby bottle and none of the disadvantages.

It is another object of the present invention to provide a new and improved air expelling apparatus which may be easily and efficiently manufactured and marketed.

It is further object of the present invention to provide a new and improved air expelling apparatus which is of durable and reliable constructions.

An even further object of the present invention is to provide a new and improved air expelling apparatus which is susceptible of a low cost of manufacture with regard to both materials and labor, and which accordingly is then susceptible of low prices of sale to the consuming public, thereby making such air expelling apparatus economically available to the buying public.

Still yet another object of the present invention is to provide a new and improved air expelling apparatus which provides in the apparatuses and methods of the prior art some of the advantages thereof, while simultaneously overcoming some of the disadvantages normally associated therewith.

Even still another object of the present invention is to provide a air expelling apparatus for bleeding the air from the liner of a cylindrical disposable baby bottle by placing the shell body of the baby bottle over of cylindrical member and pushing down on the cylindrical member.

Lastly, it is an object of the present invention to provide a new and improved air expelling apparatus including a cylindrical member that has a shell body with a closed top end, an opened bottom end and a peripheral wall with an interior area. A disk-like stand, is integral with the bottom end of the shell body, with the interior area of the shell having its opening at a bottom portion of the stand. The stand has a top portion integral with the peripheral wall of the shell body, and has a lower peripheral wall. Lastly, the stand is capable of functioning like a handle when the cylindrical member is positioned within the shell body of any disposable baby bottle. The stand allows the cylindrical member to operate in a piston-like manner when positioned through the lower opening of any disposable baby bottle and be in contact with the liner of disposable baby bottle to expel air.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
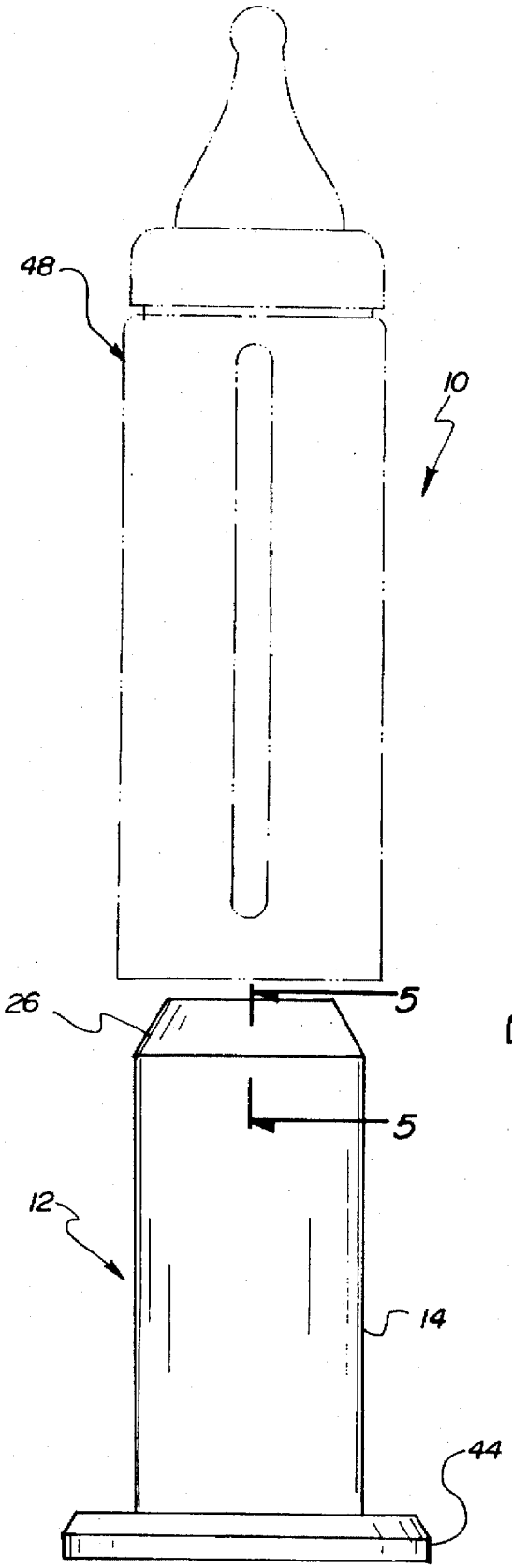
FIG. 1 is an exploded view of the preferred embodiment of the air expelling apparatus constructed in accordance with the principles of the present invention.
Figure 2:
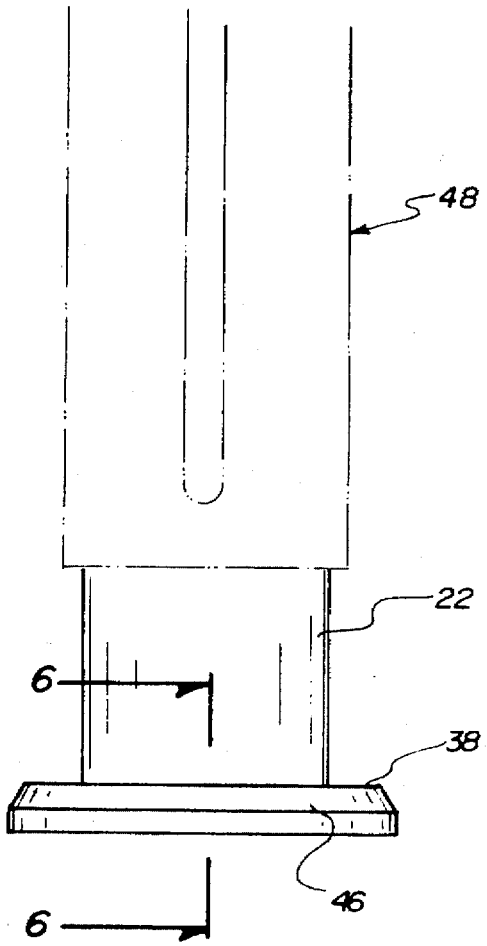
FIG. 2 is a fragmentary view of the present invention in an operable configuration.

With reference now to the drawings, and in particular to FIG. 1 thereof, the preferred embodiment of the new and improved air expelling apparatus embodying the principles and concepts of the present invention and generally designated by the reference numeral 10 will be described.

The present invention, the air expelling apparatus 10 is comprised of a plurality of components. Such components in their broadest context include a cylindrical member and a stand. Such components are individually configured and correlated with respect to each other so as to attain the desired objective.

Figure 6:
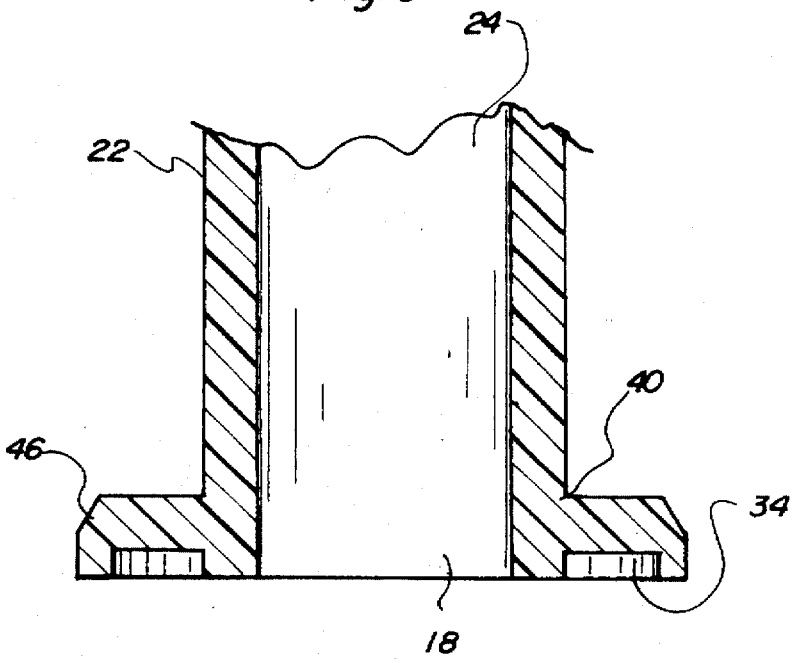
FIG. 6 is a cut-away sectional view of the present invention taken along line 6—6 of FIG. 2.

Specifically, the present invention includes an elongated cylindrical member 12. The cylindrical member, as shown in FIG. 1, has a shell body 14 with a closed top end 16, an open bottom end 18 and a peripheral wall 22. The shell body has an interior area 24, as shown in FIG. 6. The shell is preferably formed of a high density polyethylene plastic. The shell may be formed of any commercially available plastic such as polyvinylchloride and the like. The peripheral wall of the shell body has a length of about five and one-half inches and a diameter of about two inches. The shell body has a generally tapered peripheral edge 26 that is continuous with the peripheral wall and integral with the top end.

Figure 3:
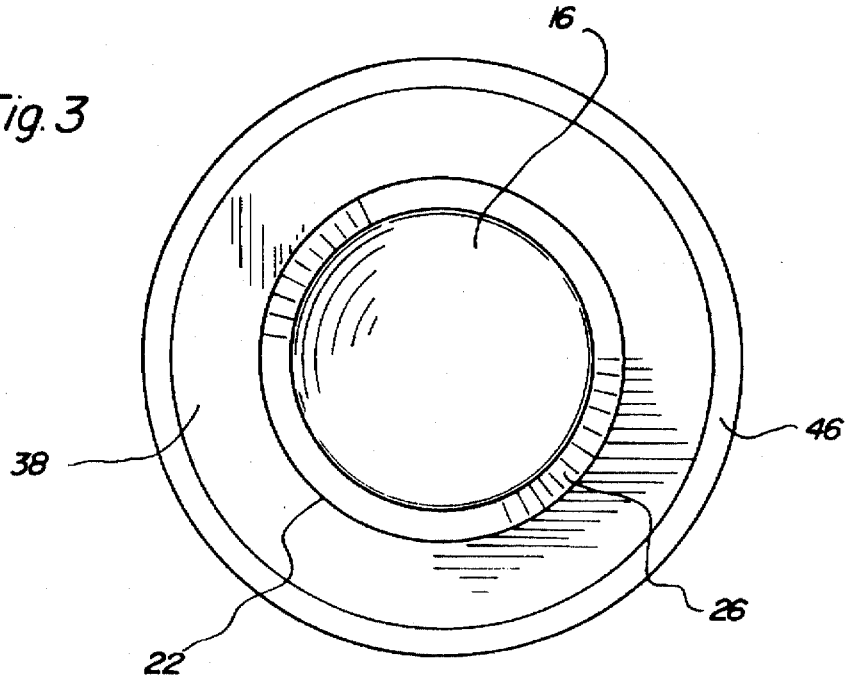
FIG. 3 is a top plan view of the present invention of FIG. 2.
Figure 4:
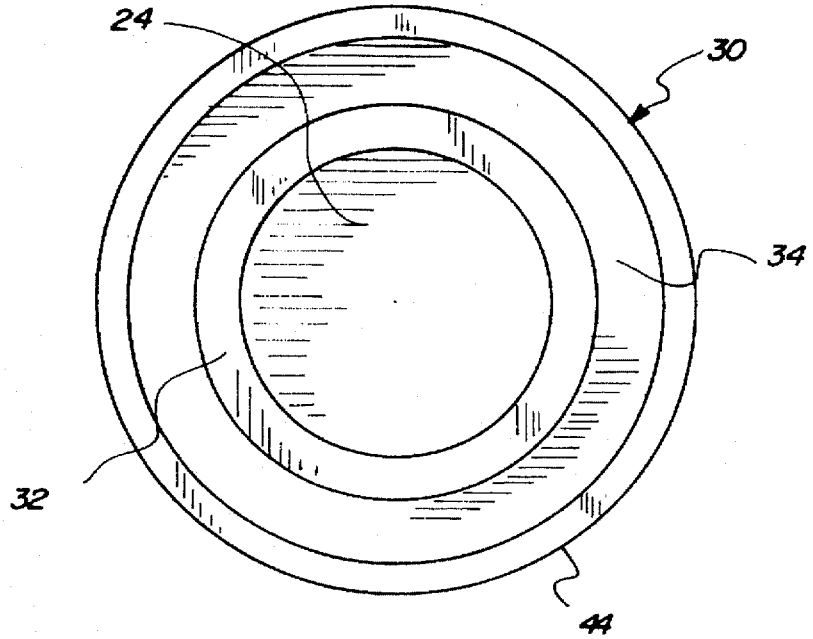
FIG. 4 is a bottom plan view of the present invention of FIG. 2.
Figure 5:
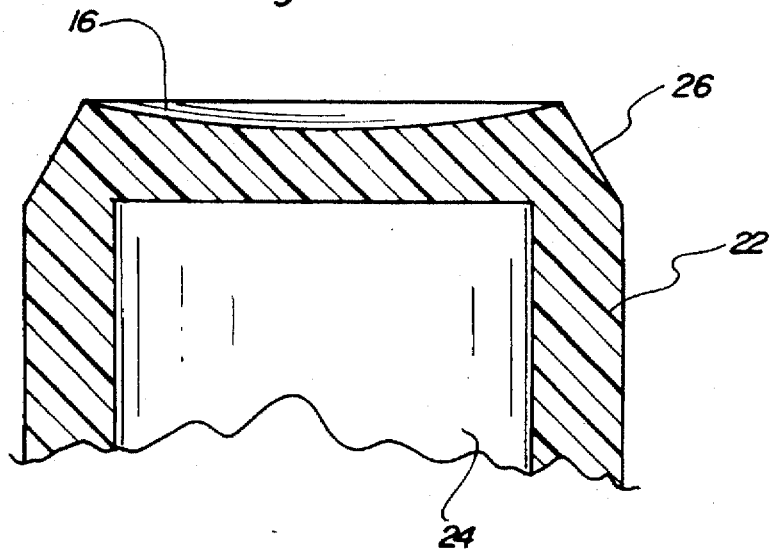
FIG. 5 is a cut-away sectional view of the present invention taken along line 5—5 of FIG. 1.

As best illustrated in FIGS. 3 and 4, a disk-like stand 30 is provided. The disk-like stand is integral with the bottom end 18 of the shell body 14 with the interior area 24 of the shell having an opening at the bottom portion 32 of the stand. The bottom portion of the stand has an air pocket 34 as shown in FIG. 6. FIG. 4 shows the air pocket traversing the stand three hundred and sixty degrees therearound.

The stand is formed of the identical plastic that is used to make the cylindrical member. The stand has a top portion 38 integral the peripheral wall 22 of the shell body at 40, as shown in FIG. 6. The stand has a lower peripheral wall 44 with a generally tapered peripheral edge 46 that is continuous therewith. The tapered peripheral edge of the stand is integral with the lower peripheral wall and the top portion. The lower peripheral wall and the peripheral edge, when combined, have a height of about three-eighths inch. The stand has a diameter of about three inches. The stand allows the cylindrical member to sit vertically on a receiving surface, with the diameter aiding in the stability of the cylindrical member remaining in the vertical position. The air pocket prevents the standing from sticking to the surface and allows the stand to be easily removed. Basically, the air pocket prevents suction-like contact between the stand and the receiving surface.

Additionally, the stand 30 is capable of functioning like a handle when the cylindrical member 12 is positioned within a shell body of any disposable baby bottle 48. The disposable baby bottle, as seen in FIG. 1, may be any cylindrical disposable baby bottle commercially available. The stand may be used to continuously move the cylindrical member along a rectilinear path in a direction away from and toward a lower opening 52 of any disposable baby bottle.

Lastly, the stand allows the cylindrical member 12 to operate in a piston-like manner, when positioned through the lower opening of the disposable baby bottle 48. The movement of the cylindrical member causes the member to be in and out of contact with the liner of any cylindrical disposable baby bottle. When the cylindrical member is moved into and out of contact with the liner, it is capable of varying the volume of the liner by expulsion of air from the liner. Also, the cylindrical member is capable of preventing reentry of the air within the liner when the disposable baby bottle is placed over the cylinder member and rests on a receiving surface.

The present invention is a air expelling apparatus for expelling air from disposable baby bottle liners that are contained within any cylindrical disposable baby bottle. In operation the bottle is placed over the apparatus and slowly pressed down until you see the air bubbles get smaller and air being released from the nipple. As the air is being released, the liquid rises to where it finally gets expelled.

The apparatus also serves as a stand for intermediate feeding which prevents the air from returning to the bottle. Air in the liner with the liquid is a common and annoying problem at the feeding times of babies. The apparatus operates in a pistol-like manner to positively remove all air and air pockets from within the liner and the baby bottle prior to feeding. This will keep feeding from being interrupted as the child no longer has the amount of gas being built up in the stomach as a result of the air passing from the baby bottle into the child. The baby bottle, when placed over the cylindrical member, may be stored with the liquid contained in the liner for later use with the child.

The cylindrical member of the present is not limited to the vertical position currently shown. The cylindrical member may be angled in any direction, away from the stand. An accessory that could be sold with the product would be a heating element that can be used to heat the liquid in the liner prior to the liquid being dispensed to the baby. Finally, another possible accessory would be a clip for fastening the present invention to the dash of a vehicle.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved air expelling apparatus for expelling air from a disposable baby bottle liner comprising in combination:

an elongated cylindrical member having a shell body with a closed top end, an open bottom end and a peripheral wall therebetween, the shell body having an interior area, the peripheral wall of the shell body having a length of about 5½ inches and a diameter of about 2 inches, the shell body having a generally tapered peripheral edge continuous with the peripheral wall and integral with the top end;

a disk-like stand being integral with the bottom end of the shell body, the interior area of the shell body having an opening at a bottom portion of the stand, an air pocket being within the bottom portion and traversing completely around the stand, the stand having a top portion integral with the peripheral wall of the shell body, the stand having a lower peripheral wall with a generally tapered peripheral edge continuous therewith, the tapered peripheral edge of the stand being integral with the lower peripheral wall and the top portion, the lower peripheral wall and the peripheral edge combined having a height of about ⅜ inch, the stand having a diameter of about 3 inches, the stand being positioned on a receiving surface and capable of allowing the cylindrical member to sit thereon in a vertical orientation, the diameter aiding in the stability of the cylindrical member when in the vertical position and the air pocket will disallow suction-like contact between the stand and a receiving surface; and the stand being capable of functioning like a handle when the cylindrical member being positionable within a shell body of a cylindrical disposable baby bottle, the stand being capable of continuously moving the cylindrical member along a rectilinear path in a direction away from and toward a lower opening of a cylindrical disposable baby bottle, the stand being capable of allowing the cylindrical member to operate in a piston-like manner, when positionable through the lower opening of a cylindrical disposable bottle, by allowing the cylindrical member to be in and out of contact with a liner within the disposable baby bottle, the cylindrical member being moved into and out of contact with the liner being capable of varying the volume of the liner for expulsion of air from therein and preventing reentry of air within.

* * * * *